US011315504B2

(12) United States Patent
Lin et al.

(10) Patent No.: US 11,315,504 B2
(45) **Date of Patent: *Apr. 26, 2022**

(54) DRIVING METHODS WITH SHAKING WAVEFORM

(71) Applicant: E Ink California, LLC, Fremont, CA (US)

(72) Inventors: Craig Lin, Fremont, CA (US); Ming Wang, Fremont, CA (US)

(73) Assignee: E INK CALIFORNIA, LLC, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/028,406

(22) Filed: Sep. 22, 2020

(65) Prior Publication Data

US 2021/0005148 A1 Jan. 7, 2021

Related U.S. Application Data

(63) Continuation of application No. 16/028,675, filed on Jul. 6, 2018, now Pat. No. 10,825,404, which is a (Continued)

(51) Int. Cl.
*G09G 3/20* (2006.01)
*G09G 3/34* (2006.01)

(52) U.S. Cl.
CPC ..... *G09G 3/344* (2013.01); *G09G 3/2003* (2013.01); *G09G 2310/068* (2013.01); *G09G 2320/0242* (2013.01)

(58) Field of Classification Search
None
See application file for complete search history.

(56) References Cited

U.S. PATENT DOCUMENTS 5,930,026 A 7/1999 Jacobson
6,753,844 B2 6/2004 Machida et al.
(Continued)

FOREIGN PATENT DOCUMENTS

JP 2009116041 A 5/2009
JP 2011158783 A 8/2011
(Continued)

OTHER PUBLICATIONS

Sprague, R.A., "Active Matrix Displays for e-readers Using Microcup Electrophoretic.", Presentation conducted at SID 2011, 49 Int'l Symposium, Seminar and Exhibition, Los Angeles Convention Center, USA (May 18, 2011). May 18, 2011.
(Continued)

*Primary Examiner* — Kent W Chang
*Assistant Examiner* — Benjamin Morales
(74) *Attorney, Agent, or Firm* — Brian D. Bean

(57) ABSTRACT

The present invention is directed to driving methods for driving an electro-optic display device which can display high quality color states. The electro-optic display may have a plurality of display pixels, a first type of pigment particle, a second type of pigment particle, and a third type of pigment particle, wherein the three types of pigment particles have optical characteristics differing from one another, the method may include: (i) driving a display pixel to the color state of the first type of pigment particles or the color state of the second type of pigment particles; (ii) driving the pixel to a grey state between the color state of the first type of pigment particle and the color state of the second type of pigment particles; and (iii) applying at least one pair of opposite driving pulses.

10 Claims, 4 Drawing Sheets

Related U.S. Application Data continuation of application No. 15/088,465, filed on Apr. 1, 2016, now Pat. No. 10,032,419.

(60) Provisional application No. 62/143,631, filed on Apr. 6, 2015.

(56) References Cited

U.S. PATENT DOCUMENTS

| | | | |
|---|---|---|---|
| 6,930,818 | B1 | 8/2005 | Liang et al. |
| 7,349,147 | B2 | 3/2008 | Chopra et al. |
| 7,675,502 | B2 | 3/2010 | Chopra et al. |
| 7,834,844 | B2 | 11/2010 | Kim et al. |
| 7,875,307 | B2 | 1/2011 | Lin et al. |
| 8,035,611 | B2 | 10/2011 | Sakamoto |
| 8,319,724 | B2 | 11/2012 | Wang et al. |
| 8,520,296 | B2 | 8/2013 | Wang et al. |
| 8,674,978 | B2 | 3/2014 | Komatsu et al. |
| 8,687,265 | B2 | 4/2014 | Ahn et al. |
| 8,791,896 | B2 | 7/2014 | Kwon et al. |
| 8,963,903 | B2 | 2/2015 | Sakamoto et al. |
| 8,964,282 | B2 | 2/2015 | Wang et al. |
| 9,013,516 | B2 | 4/2015 | Sakamoto et al. |
| 9,170,468 | B2 | 10/2015 | Lin et al. |
| 9,360,733 | B2 | 6/2016 | Wang et al. |
| 9,812,073 | B2 | 11/2017 | Lin et al. |
| 9,922,603 | B2 | 3/2018 | Lin |
| 10,032,419 | B2 | 7/2018 | Lin et al. |
| 10,339,876 | B2 | 7/2019 | Lin et al. |
| 2006/0290652 | A1 | 12/2006 | Zhou et al. |
| 2007/0070028 | A1 | 3/2007 | Zhou et al. |
| 2007/0075963 | A1 | 4/2007 | Zhou et al. |
| 2007/0080926 | A1 | 4/2007 | Zhou et al. |
| 2007/0091117 | A1 | 4/2007 | Zhou et al. |
| 2008/0062159 | A1 | 3/2008 | Roh et al. |
| 2008/0150886 | A1 | 6/2008 | Johnson et al. |
| 2008/0224989 | A1 | 9/2008 | Zhou et al. |
| 2008/0231593 | A1* | 9/2008 | Johnson ..... G09G 3/344 345/107 |
| 2008/0266243 | A1 | 10/2008 | Johnson et al. |
| 2010/0194733 | A1 | 8/2010 | Lin et al. |
| 2011/0128267 | A1 | 6/2011 | Hsu |

FOREIGN PATENT DOCUMENTS

| | | | |
|---|---|---|---|
| KR | 20070082680 | A | 8/2007 |
| TW | 200938928 | A | 9/2009 |

OTHER PUBLICATIONS

Kao, W.C., "Configurable Timing Controller Design for Active Matrix Electrophoretic Display.", IEEE Transactions on Consumer Electronics, vol. 55, Issue 1, pp. 1-5 (Feb. 2009). Feb. 1, 2009.

Kao, W.C. et al., "Configurable Timing Controller Design for Active Matrix Electrophoretic Display with 16 Gray Levels.", ICCE 2009 Digest of Technical Papers, 10.2-2, (Jan. 2009). Jan. 14, 2009.

Kao, W.C. et al., "Integrating Flexible Electrophoretic Display And One-Time Password Generator in Smart Cards.", ICCE Digest of Technical Papers, p. 4-3, (Jan. 2008). Jan. 13, 2008.

Federal Institute of Industrial Property, PCT/US2016/025504, International Search Report and Written Opinion, Russian Federation, dated Aug. 18, 2016. Aug. 18, 2016.

European Patent Office, EP Appl. No. 16777083.3, Extended European Search Report, dated Aug. 1, 2018. Aug. 1, 2018.

* cited by examiner

DRIVING METHODS WITH SHAKING WAVEFORM

This application is a Continuation of and claims priority to U.S. application Ser. No. 16/028,675 filed Jul. 6, 2018. Where the Ser. No. 16/028,675 application itself is a Continuation of and claims priority to U.S. application Ser. No. 15/088,465 filed on Apr. 1, 2016. Where the Ser. No. 15/088,465 application itself claims priority to provisional Application No. 62/143,631, filed Apr. 6, 2015, the contents of the which is incorporated herein by reference in its entirety.

FIELD OF THE INVENTION

The present invention is directed to driving methods for color display devices to display high quality color states.

BACKGROUND OF THE INVENTION

In order to achieve a color display, color filters are often used. The most common approach is to add color filters on top of black/white sub-pixels of a pixellated display to display the red, green and blue colors. When a red color is desired, the green and blue sub-pixels are turned to the black state so that the only color displayed is red. When a blue color is desired, the green and red sub-pixels are turned to the black state so that the only color displayed is blue. When a green color is desired, the red and blue sub-pixels are turned to the black state so that the only color displayed is green. When a black state is desired, all three-sub-pixels are turned to the black state. When a white state is desired, the three sub-pixels are turned to red, green and blue, respectively, and as a result, a white state is seen by the viewer.

The biggest disadvantage of such a technique is that since each of the sub-pixels has a reflectance of about one third (⅓) of the desired white state, the white state is fairly dim. To compensate this, a fourth sub-pixel may be added which can display only the black and white states, so that the white level is doubled at the expense of the red, green or blue color level (where each sub-pixel is now only one fourth of the area of a pixel). Brighter colors can be achieved by adding light from the white pixel, but this is achieved at the expense of color gamut to cause the colors to be very light and unsaturated. A similar result can be achieved by reducing the color saturation of the three sub-pixels. Even with these approaches, the white level is normally substantially less than half of that of a black and white display, rendering it an unacceptable choice for display devices, such as e-readers or displays that need well readable black-white brightness and contrast.

SUMMARY

According to one aspect of the subject matter disclosed herein, a driving method for driving an electro-optic display having a plurality of display pixels, a first type of pigment particle, a second type of pigment particle, and a third type of pigment particle, wherein the three types of pigment particles have optical characteristics differing from one another, the method may include the following steps: (i) driving a display pixel to the color state of the first type of pigment particles or the color state of the second type of pigment particles; (ii) driving the pixel to a grey state between the color state of the first type of pigment particle and the color state of the second type of pigment particles; and (iii) applying at least one pair of opposite driving pulses.

DETAILED DESCRIPTION OF THE INVENTION

The present invention is directed to driving methods for color display devices.

Figure 1:
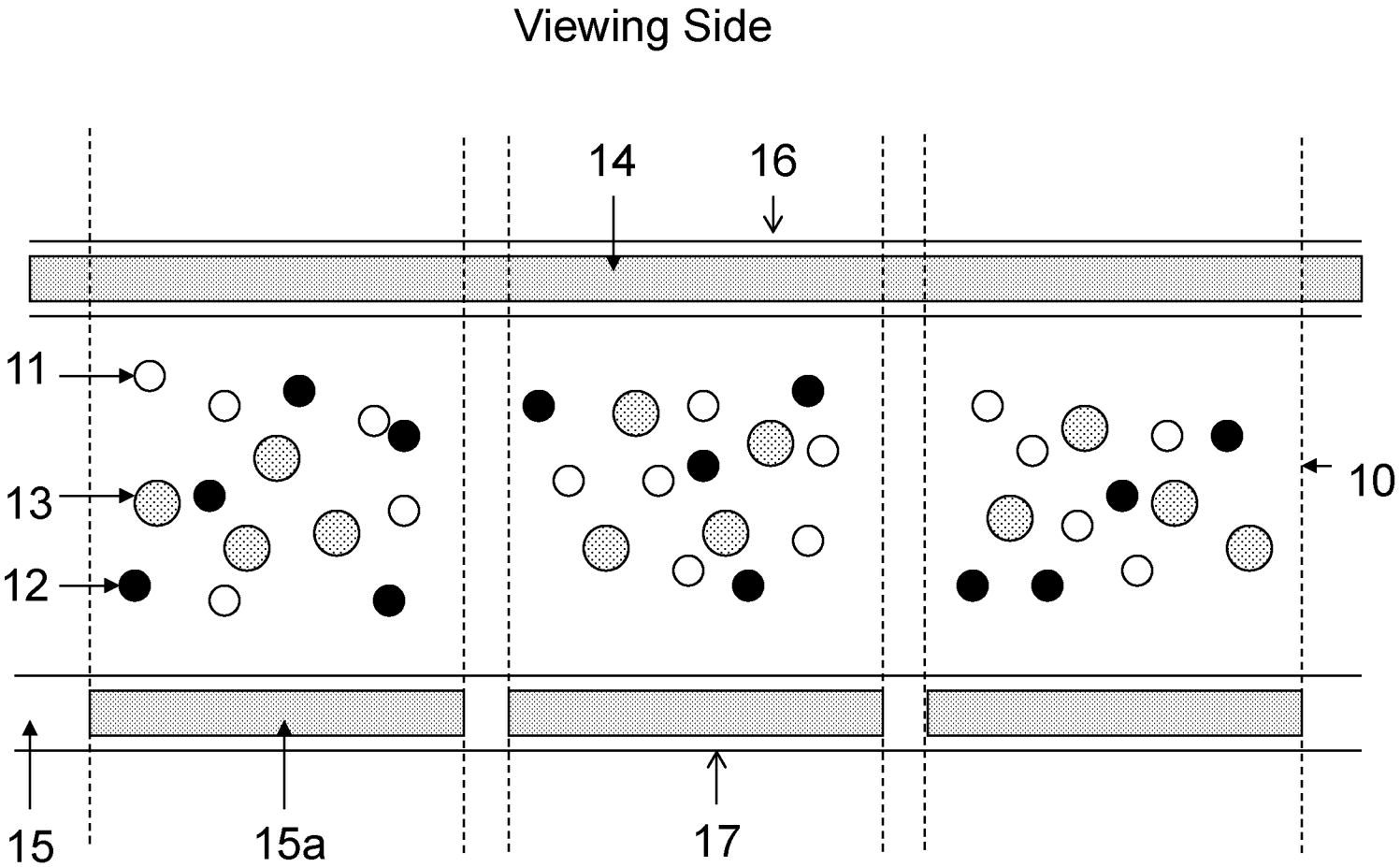
FIG. 1 depicts an electrophoretic display fluid applicable to the present invention.

The device utilizes an electrophoretic fluid is shown in FIG. 1. The fluid comprises three types of pigment particles dispersed in a dielectric solvent or solvent mixture. For ease of illustration, the three types of pigment particles may be referred to as white particles (11), black particles (12) and colored particles (13). The colored particles are non-white and non-black.

However, it is understood that the scope of the invention broadly encompasses pigment particles of any colors as long as the three types of pigment particles have visually distinguishable colors. Therefore, the three types of pigment particles may also be referred to as a first type of pigment particles, a second type of pigment particles and a third type of pigment particles.

For the white particles (11), they may be formed from an inorganic pigment, such as $TiO_2$, $ZrO_2$, ZnO, $Al_2O_3$, $Sb_2O_3$, $BaSO_4$, $PbSO_4$ or the like.

For the black particles (12), they may be formed from CI pigment black 26 or 28 or the like (e.g., manganese ferrite black spinel or copper chromite black spinel) or carbon black.

The third type of particles may be of a color such as red, green, blue, magenta, cyan or yellow. The pigments for this type of particles may include, but are not limited to, CI pigment PR 254, PR122, PR149, PG36, PG58, PG7, PB28, PB15:3, PY138, PY150, PY155 or PY20. Those are commonly used organic pigments described in color index handbook "New Pigment Application Technology" (CMC Publishing Co, Ltd, 1986) and "Printing Ink Technology" (CMC Publishing Co, Ltd, 1984). Specific examples include Clariant Hostaperm Red D3G 70-EDS, Hostaperm Pink E-EDS, PV fast red D3G, Hostaperm red D3G 70, Hostaperm Blue B2G-EDS, Hostaperm Yellow H4G-EDS, Hostaperm Green GNX, BASF Irgazine red L 3630, Cinquasia Red L 4100 HD, and Irgazin Red L 3660 HD; Sun Chemical phthalocyanine blue, phthalocyanine green, diarylide yellow or diarylide AAOT yellow.

In addition to the colors, the first, second and third types of particles may have other distinct optical characteristics, such as optical transmission, reflectance, luminescence or, in the case of displays intended for machine reading, pseudo-color in the sense of a change in reflectance of electromagnetic wavelengths outside the visible range.

The solvent in which the three types of pigment particles are dispersed may be clear and colorless. It preferably has a low viscosity and a dielectric constant in the range of about 2 to about 30, preferably about 2 to about 15 for high particle mobility. Examples of suitable dielectric solvent include hydrocarbons such as isopar, decahydronaphthalene (DECALIN), 5-ethylidene-2-norbornene, fatty oils, paraffin oil, silicon fluids, aromatic hydrocarbons such as toluene, xylene, phenylxylylethane, dodecylbenzene or alkylnaphthalene, halogenated solvents such as perfluorodecalin, perfluorotoluene, perfluoroxylene, dichlorobenzotrifluoride, 3,4,5-trichlorobenzotrifluoride, chloropentafluoro-benzene, dichlorononane or pentachlorobenzene, and perfluorinated solvents such as FC-43, FC-70 or FC-5060 from 3M Company, St. Paul Minn., low molecular weight halogen containing polymers such as poly(perfluoropropylene oxide) from TCI America, Portland, Oreg., poly(chlorotrifluoroethylene) such as Halocarbon Oils from Halocarbon Product Corp., River Edge, N.J., perfluoropolyalkylether such as Galden from Ausimont or Krytox Oils and Greases K-Fluid Series from DuPont, Del., polydimethylsiloxane based silicone oil from Dow-corning (DC-200).

A display layer utilizing the display fluid of the present invention has two surfaces, a first surface (16) on the viewing side and a second surface (17) on the opposite side of the first surface (16). The second surface therefore is on the non-viewing side. The term "viewing side" refers to the side at which images are viewed.

The display fluid is sandwiched between the two surfaces. On the side of the first surface (16), there is a common electrode (14) which is a transparent electrode layer (e.g., ITO), spreading over the entire top of the display layer. On the side of the second surface (17), there is an electrode layer (15) which comprises a plurality of pixel electrodes (15*a*).

The display fluid is filled in display cells. The display cells may be aligned with or not aligned with the pixel electrodes. The term "display cell" refers a micro-container which is filled with an electrophoretic fluid. Examples of "display cells" may include the cup-like microcells as described in U.S. Pat. No. 6,930,818 and microcapsules as described in U.S. Pat. No. 5,930,026. The micro-containers may be of any shapes or sizes, all of which are within the scope of the present application.

An area corresponding to a pixel electrode may be referred to as a pixel (or a sub-pixel). The driving of an area corresponding to a pixel electrode is effected by applying a voltage potential difference (or known as a driving voltage or an electric field) between the common electrode and the pixel electrode.

The pixel electrodes may be of an active matrix driving system with a thin film transistor (TFT) backplane, or other types of electrode addressing as long as the electrodes serve the desired functions.

The space between two vertical dotted lines denotes a pixel (or a sub-pixel). For brevity, when "pixel" is referred to in a driving method, the term also encompasses "sub-pixel"s.

Two of the three types of pigment particles carry opposite charge polarities and the third type of pigment particles is slightly charged. The term "slightly charged" or "lower charge intensity" is intended to refer to the charge level of the particles being less than about 50%, preferably about 5% to about 30%, the charge level of the stronger charged particles. In one embodiment, the charge intensity may be measured in terms of zeta potential. In one embodiment, the zeta potential is determined by Colloidal Dynamics AcoustoSizer IIM with a CSPU-100 signal processing unit, ESA EN #Attn flow through cell (K:127). The instrument constants, such as density of the solvent used in the sample, dielectric constant of the solvent, speed of sound in the solvent, viscosity of the solvent, all of which at the testing temperature (25° C.) are entered before testing. Pigment samples are dispersed in the solvent (which is usually a hydrocarbon fluid having less than 12 carbon atoms), and diluted to between 5-10% by weight. The sample also contains a charge control agent (Solsperse 17000®, available from Lubrizol Corporation, a Berkshire Hathaway company; "Solsperse" is a Registered Trade Mark), with a weight ratio of 1:10 of the charge control agent to the particles. The mass of the diluted sample is determined and the sample is then loaded into the flow through cell for determination of the zeta potential.

For example, if the black particles are positively charged and the white particles are negatively charged, and then the colored pigment particles may be slightly charged. In other words, in this example, the charge levels carried by the black and the white particles are higher than the charge level carried by the colored particles.

In addition, the colored particles which carries a slight charge has a charge polarity which is the same as the charge polarity carried by either one of the other two types of the stronger charged particles.

It is noted that among the three types of pigment particles, the one type of particles which is slightly charged preferably may have a larger size.

In addition, in the context of the present application, a high driving voltage ($V_{H1}$ or $V_{H2}$) is defined as a driving voltage which is sufficient to drive a pixel from one extreme color state to another extreme color state. If the first and the second types of pigment particles are the higher charged particles, a high driving voltage then ($V_{H1}$ or $V_{H2}$) refers a driving voltage which is sufficient to drive a pixel from the color state of the first type of pigment particles to the color state of the second type of pigment particles, or vice versa. For example, a high driving voltage, $V_{H1}$, refers to a driving voltage which is sufficient to drive a pixel from the color state of the first type of pigment particles to the color state of the second type of pigment particles when applied for an appropriate period of time, and $V_{H2}$ refers to a driving voltage which is sufficient to drive a pixel from the color state of the second type of pigment particles to the color state of the first type of pigment particles when applied for an appropriate period of time.

The following is an example illustrating a driving scheme of how different color states may be displayed by an electrophoretic fluid as described above.

Example

Figure 2:
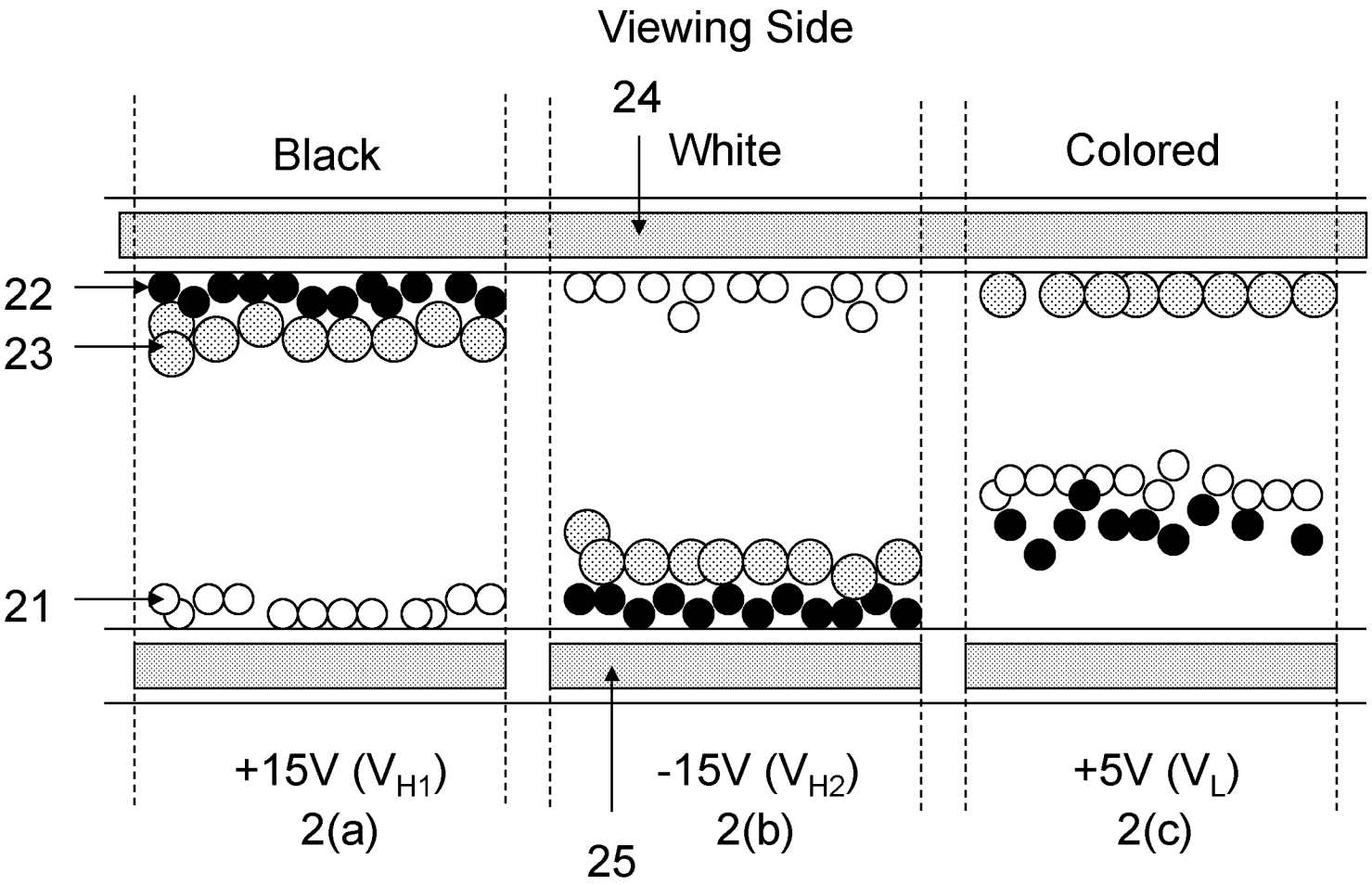
FIG. 2 is a diagram depicting an example of driving scheme.

This example is demonstrated in FIG. 2. The white pigment particles (21) are negatively charged while the black pigment particles (22) are positively charged, and both types of the pigment particles may be smaller than the colored particles (23).

The colored particles (23) carry the same charge polarity as the black particles, but are slightly charged. As a result, the black particles move faster than the colored particles (23) under certain driving voltages.

In FIG. 2*a*, the applied driving voltage is +15V (i.e., $V_{H1}$). In this case, the white particles (21) move to be near or at the pixel electrode (25) and the black particles (22) and the colored particles (23) move to be near or at the common electrode (24). As a result, the black color is seen at the viewing side. The colored particles (23) move towards the common electrode (24) at the viewing side; however because their lower charge intensity and larger size, they move slower than the black particles.

In FIG. 2*b*, when a driving voltage of −15V (i.e., $V_{H2}$) is applied, the white particles (21) move to be near or at the common electrode (24) at the viewing side and the black particles and the colored particles move to be near or at the pixel electrode (25). As a result, the white color is seen at the viewing side.

It is noted that $V_{H1}$ and $V_{H2}$ have opposite polarities, and have the same amplitude or different amplitudes. In the example as shown in FIG. 2, $V_{H1}$ is positive (the same polarity as the black particles) and $V_{H2}$ is negative (the same polarity as the white particles)

In FIG. 2*c*, when a low voltage (e.g., +5V) which is sufficient to drive the colored particles to the viewing side and has the same polarity as the colored particles, is applied, the white particles are pushed downwards and the colored particles move up towards the common electrode (24) to reach the viewing side. The black particles cannot move to the viewing side because of the low driving voltage which is not sufficient to separate the two stronger and oppositely charged particles, i.e., the black particles and the white particles, from each other when the two types of pigment particles meet.

There are two issues that could impact on the quality of each of the three color states.

One of the issues is color tint of the black and white states. If the colored particles are red, the white state may suffer from having a red tint (i.e., a high a* value), which comes from the red particles that did not separate well from the white particles. Although the white and red particles carry opposite charge polarities, a small amount of the red particles shown on the viewing side at the white state could cause a red tint, which is unpleasant to the viewer.

The black state also suffers from the red tint. The black and red particles carry the same charge polarity, but with different levels of charge intensity. The higher charged black particles are expected to move faster than the lower charged red particles to show a good black state, without the red tint; but, in practice, the red tint is hard to avoid.

The second issue is the ghosting phenomenon, which is caused by pixels driven from different color states to the same color state and the resulting color state often shows differences in L* (i.e., ΔL*) and/or differences in a* (i.e., Δa*), because the previous states are of different colors.

In one example, two groups of pixels are driven concurrently to a black state. The first group of pixels driven from a white state to the black state may show an L* of 15, and the other group of pixels driven from a black state to the end black state may show an L* of 10. In this case, the end black state will have ΔL* of 5.

In another example of a three color system as shown in FIG. 2, three groups of pixels are driven concurrently to a black state. The first group of pixels driven from red to the black state may show an L* of 17 and an a* value of 7 (a high a* value here, also indicative of color tinting). The second group of pixels driven from a black state to the end black state may show an L* of 10 and an a* value of 1. The third group of pixels driven from a white state to the end black state may show an L* of 15 and an a* of 3. In this case, the most severe ghosting is resulted from ΔL* being 7 and Δa* being 6.

The present inventors have now found driving methods which can provide improvement on both issues. In other words, the present driving methods can reduce/eliminate not only color tinting (i.e., lowering the a* value of the black and/or white state) but also ghosting (i.e., lowering ΔL* and Δa*).

Figure 3:
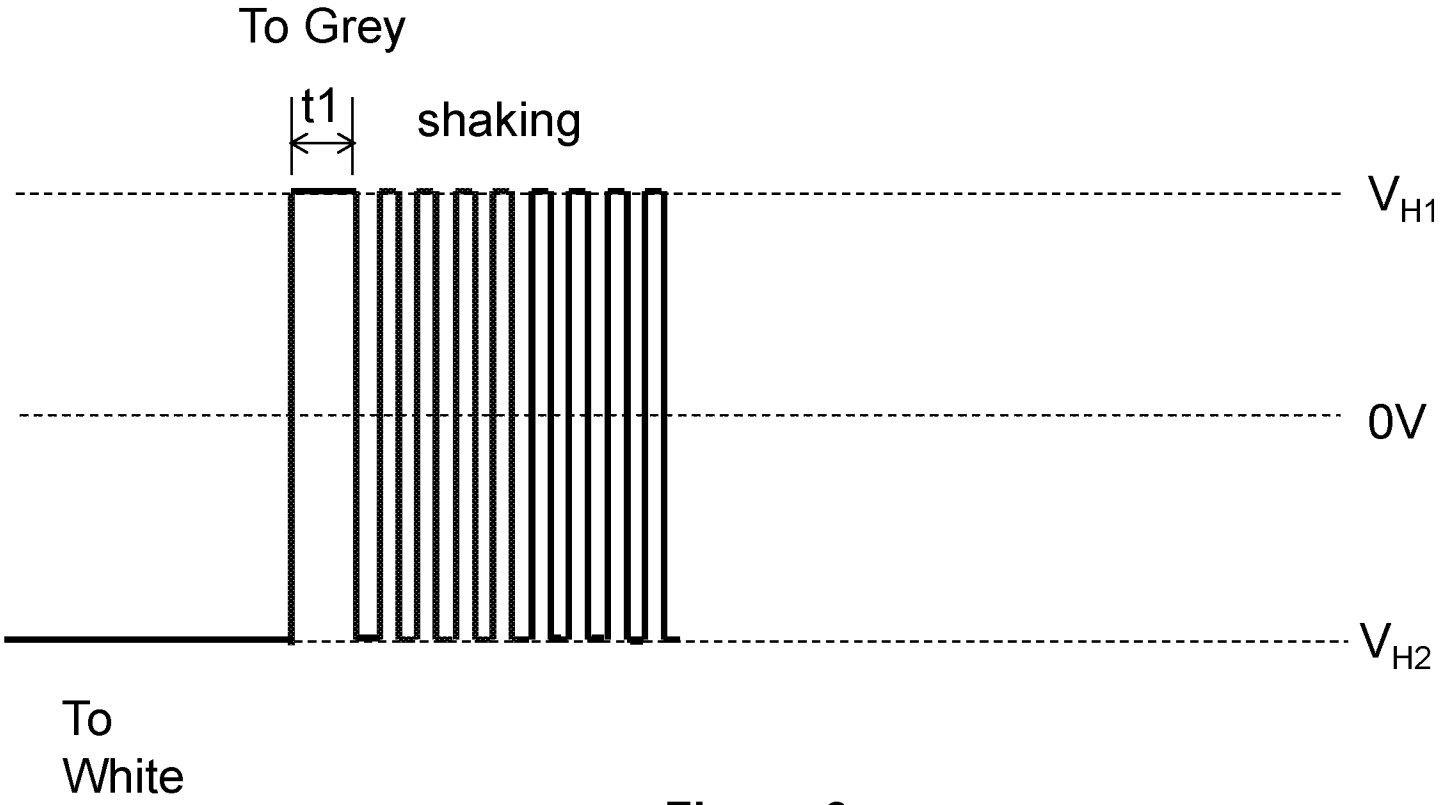
FIG. 3 illustrates a driving method of the present invention.
Figure 4:
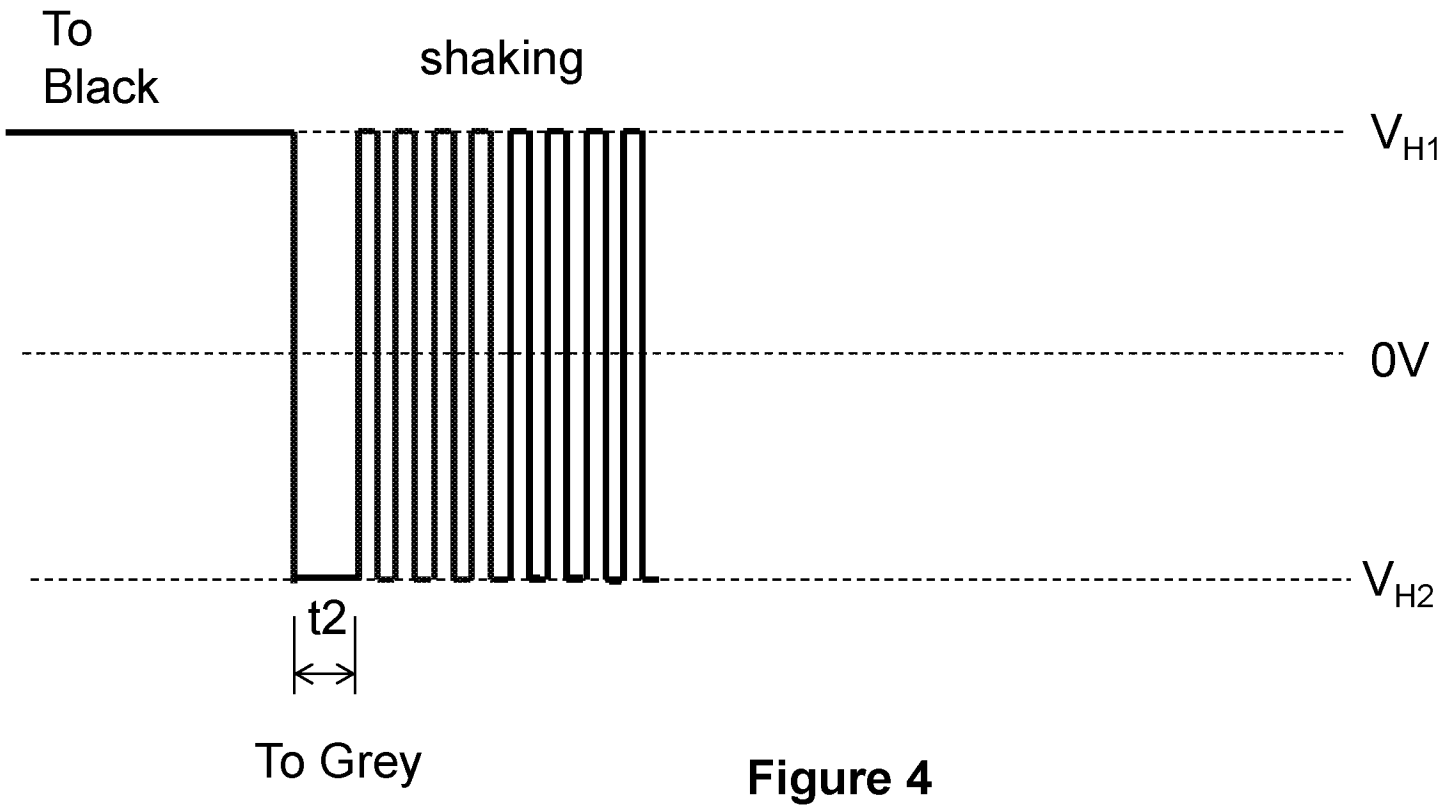
FIG. 4 illustrates an alternative driving method of the present invention.

FIGS. 3 and 4 illustrate the driving methods of the present invention. Each of the methods may also be viewed as "re-set" or "pre-condition", prior to driving a pixel to a desired color state.

The waveform in FIG. 3 comprises three parts, (i) driving to white, (ii) applying a driving voltage ($V_{H1}$, e.g., +15V) having the same polarity as that of the black particles for a short period of time, t1, which is not sufficiently long to drive from the white state to the black state, resulting in a grey state, and (iii) shaking.

The waveform in FIG. 4 comprises three parts, (i) driving to black, (ii) applying a driving voltage ($V_{H2}$, e.g., −15V) having the same polarity as that of the white particles for a short period of time, t2, which is not sufficiently long to drive from the black state to the white state, resulting in a grey state, and (iii) shaking.

The length of t1 or t2 would depend on not only the final color state driven to (after the re-set and pre-condition waveform of FIG. 3 or 4), but also the desired optical performance of the final color state (e.g., a*, ΔL* and Δa*). For example, there is least ghosting when t1 in the waveform of FIG. 3 is 40 msec and pixels are driven to the red state regardless of whether they are driven from red, black or white. Similarly, there is least ghosting when t1 is 60 msec and pixels are driven to the black state regardless of whether they are driven from red, black or white.

The notation, "msec", stands for millisecond.

The shaking waveform consists of repeating a pair of opposite driving pulses for many cycles. For example, the shaking waveform may consist of a +15V pulse for 20 msec and a −15V pulse for 20 msec and such a pair of pulses is repeated for 50 times. The total time of such a shaking waveform would be 2000 msec.

Each of the driving pulses in the shaking waveform is applied for not exceeding half of the driving time required for driving from the full black state to the full white state, or vice versa. For example, if it takes 300 msec to drive a pixel from a full black state to a full white state, or vice versa, the shaking waveform may consist of positive and negative pulses, each applied for not more than 150 msec. In practice, it is preferred that the pulses are shorter.

It is noted that in FIGS. 3 and 4, the shaking waveform is abbreviated (i.e., the number of pulses is fewer than the actual number).

After shaking is completed, the three types of particles should be in a mixed state in the display fluid.

After this "re-set" or "pre-condition" of FIG. 3 or 4 is completed, a pixel is then driven to a desired color state (e.g., black, red or white). For example, a positive pulse may be applied to drive the pixel to black; a negative pulse may be applied to drive the pixel to white; or a negative pulse followed by a positive pulse of lower amplitude may be applied to drive the pixel to red.

When comparing driving methods with or without the "re-set" or "pre-condition" of the present invention, the methods with the "re-set" or "pre-condition" of the present invention have the added advantage of shorter waveform time in achieving the same levels of optical performance (including ghosting).

The driving methods of the present invention can be summarized as follows:

A driving method for an electrophoretic display comprising a first surface on the viewing side, a second surface on the non-viewing side and an electrophoretic fluid which fluid is sandwiched between a common electrode and a layer of pixel electrodes and comprises a first type of pigment particles, a second type of pigment particles and a third type of pigment particles, all of which are dispersed in a solvent or solvent mixture, wherein (a) the three types of pigment particles have optical characteristics differing from one another;

(b) the first type of pigment particles and the second type of pigment particles carry opposite charge polarities; and (c) the third type of pigment particles has the same charge polarity as the second type of pigment particles but at a lower intensity, which method comprises the following steps:

(i) driving a pixel in the electrophoretic display to the color state of the first type of pigment particles or the color state of the second type of pigment particles;

(ii) applying a first driving voltage to the pixel in the color state of the first type of pigment particles for a first period of time, which driving voltage has the same polarity as the second type of pigment particles and the first period of time is not sufficiently long to drive the pixel to the color state of the second type of pigment particles, or applying a second driving voltage to the pixel in the color state of the second type of pigment particles for a second period of time, which driving voltage has the same polarity as the first type of pigment particles and the second period of time is not sufficiently long to drive the pixel to the color state of the first type of pigment particles; and (iii) applying a shaking waveform.

In one embodiment, the first type of pigment particles is negatively charged and the second type of pigment particles is positively charged.

In one embodiment, the first type of pigment particles is white and the second type of pigment particles is black.

In one embodiment, the third type of pigment particles is red.

While the present invention has been described with reference to the specific embodiments thereof, it should be understood by those skilled in the art that various changes may be made and equivalents may be substituted without departing from the scope of the invention. In addition, many modifications may be made to adapt a particular situation, materials, compositions, processes, process step or steps, to the objective and scope of the present invention. All such modifications are intended to be within the scope of the claims appended hereto.

What is claimed is:

1. A driving method for driving an electro-optic display having a plurality of display pixels, and an electrophoretic fluid comprising a first type of pigment particle, a second type of pigment particle, and a third type of pigment particle, wherein the three types of pigment particles have optical characteristics differing from one another, the method comprising the following steps, in this order:

(i) driving a display pixel to the color state of the first type of pigment particles or the color state of the second type of pigment particles;

(ii) immediately after the completion of step (i), driving the pixel to a grey state between the color state of the first type of pigment particle and the color state of the second type of pigment particles; and (iii) immediately after the completion of step (ii), applying a shaking waveform comprising at least one pair of opposite driving pulses, wherein at the end of the shaking waveform the three types of pigment particles are mixed in the electrophoretic fluid.

2. The method of claim 1, wherein the first type of pigment particles is negatively charged and the second type of pigment particles is positively charged.

3. The method of claim 1, wherein the three types of pigment particles have different colors.

4. The method of claim 1, wherein the first type of pigment particles is white and the second type of pigment particles is black.

5. The method of claim 1, wherein the third type of pigment particles is non-white and non-black.

6. The method of claim 1, wherein the third type of pigment particles is red.

7. The method of claim 1, following the step of applying at least one pair of opposite driving pulses, applying a driving voltage having the same polarity as the first type of pigment particles to drive the pixel to the color state of the first type of pigment particles at the viewing side.

8. The method of claim 1, following the step of applying at least one pair of opposite driving pulses, applying a driving voltage having the same polarity as the second type of pigment particles to drive the pixel to the color state of the second type of pigment particles at the viewing side.

9. The method of claim 1, following the step of applying at least one pair of opposite driving pulses, applying a driving voltage having the same polarity as the third type of pigment particles to drive the pixel to the color state of the third type of pigment particles at the viewing side.

10. The method of claim 1, wherein the first type of pigment particles and the second type of pigment particles carry opposite charge polarities.

* * * * *